US005927946A

United States Patent [19]

Lee

[11] Patent Number: 5,927,946

[45] Date of Patent: Jul. 27, 1999

[54] TURBINE BLADE HAVING RECUPERATIVE TRAILING EDGE TIP COOLING

[75] Inventor: Ching-Pang Lee, Cincinnati, Ohio

[73] Assignee: General Electric Company, Cincinnati, Ohio

[21] Appl. No.: 08/939,761

[22] Filed: Sep. 29, 1997

[51] Int. Cl.[6] ..... F01D 5/18

[52] U.S. Cl. ..... 416/97 R; 416/92; 416/224; 416/231 R; 415/115

[58] Field of Search ..... 416/92, 97 R, 416/224, 231 R, 231 B; 415/115

[56] References Cited

U.S. PATENT DOCUMENTS

| | | | |
|---|---|---|---|
| 3,635,585 | 1/1972 | Metzler, Jr. | 416/96 |
| 4,257,737 | 3/1981 | Andress et al. | 416/97 R |
| 4,424,001 | 1/1984 | North et al. | 416/92 |
| 4,606,701 | 8/1986 | McClay et al. | 416/92 |
| 4,761,116 | 8/1988 | Braddy et al. | 416/92 |
| 4,893,987 | 1/1990 | Lee et al. | 416/92 |
| 5,125,798 | 6/1992 | Muth et al. | 416/92 |
| 5,468,125 | 11/1995 | Okpara et al. | 415/115 |
| 5,503,527 | 4/1996 | Lee et al. | 416/91 |
| 5,564,902 | 10/1996 | Tomita | 416/97 R |
| 5,733,102 | 3/1998 | Lee et al. | 416/97 R |
| 5,772,398 | 6/1998 | Noiret et al. | 415/115 |

FOREIGN PATENT DOCUMENTS

| | | | |
|---|---|---|---|
| 403141801 | 6/1991 | Japan | 416/231 B |

*Primary Examiner*—F. Daniel Lopez
*Assistant Examiner*—Matthew T. Shanley
*Attorney, Agent, or Firm*—Andrew C. Hess; Rodney M. Young

[57] ABSTRACT

A gas turbine engine rotor blade includes an airfoil having a concave side wall and a convex side wall joined together at leading and trailing edges. Concave and convex tip walls extend from adjacent the leading edge along the respective concave and convex side walls to adjacent the trailing edge and are spaced apart to define a tip cavity therebetween. A hole or channel is disposed in a trailing edge tip region connecting the tip cavity to the trailing edge for channeling cooling fluid through the trailing edge tip region.

5 Claims, 3 Drawing Sheets

TURBINE BLADE HAVING RECUPERATIVE TRAILING EDGE TIP COOLING

BACKGROUND OF THE INVENTION

This invention generally relates to gas turbine rotor blades and more particularly to cooling the trailing edge tip region of turbine rotor blades.

Turbine rotor blades of certain varieties operate in extremely high temperature environments. In order to achieve adequate service life, the blades typically include hollow airfoils so that cooling fluid (usually air) can be routed to interior cavities and reduce the high surface temperatures. An area that is troublesome in this regard is the blade tip, the radial extremity of the blade, and particularly, the trailing edge region of the blade tip.

The proximity of the blade tip to a circumscribing shroud makes the blade tip difficult to cool. The shroud defines a flow path for the operating fluid of the turbomachine. The contiguity of the shroud and the blade tip minimizes the leakage of hot operating fluid past the tip which correspondingly improves turbine efficiency. A tip cavity comprising a recessed tip cap surrounded by radially extending side walls provides a means for achieving minimal tip clearance while at the same time assuring adequate blade tip cooling. Cooling fluid, exhausted from the interior cavity, is fed into the tip cavity through holes in the tip cap, cooling the radially extending side walls as well as the tip cap surface.

The trailing edge tip of the blade is particularly thin, lacking the appropriate wall thickness to extend the tip cavity to the trailing edge tip corner. In order to prevent oxidation of the trailing edge tip, additional cooling holes extending radially through the trailing edge tip to the internal cavity may be provided. However, the penalty of this arrangement is a reduction in cooling air to the trailing edge region of the blade resulting in higher operating temperatures which enhances blade deterioration.

For the foregoing reasons, there is a need for a blade tip design having improved blade tip trailing edge cooling.

SUMMARY OF THE INVENTION

The present invention is directed to a gas turbine engine rotor blade which includes a means for cooling the trailing edge tip without having to extract additional cooling air from the internal cavity of the airfoil.

The gas turbine engine rotor blade comprises of an airfoil having a pressure side wall and a suction side wall connected at a leading edge and a trailing edge. Both the suction side wall and the pressure side wall extend beyond a tip cap forming a tip cavity. An internal cavity disposed within the airfoil for receiving cooling fluid therein is connected to the tip cavity by way of at least one radial passage providing a means for cooling the tip cavity. An aperture extending along the meanline of the airfoil connects the trailing edge tip corner to the tip cavity so that the cooling air entering the tip cavity can be further utilized for cooling the trailing edge tip corner, eliminating the need for extracting additional cooling fluid from the internal cavity.

In alternate embodiment, the cooling of the trailing edge tip corner utilizing cooling entering the tip cavity is accomplished by way of a channel extending along the meanline of the airfoil connecting the trailing edge tip corner to the tip cavity.

BRIEF DESCRIPTION OF THE DRAWINGS

These and other features, aspects, and advantages of the present invention will become better understood with regard to the following detailed description and appended claims taken in conjunction with the accompanying drawings where:

DESCRIPTION OF THE INVENTION

Figure 1:
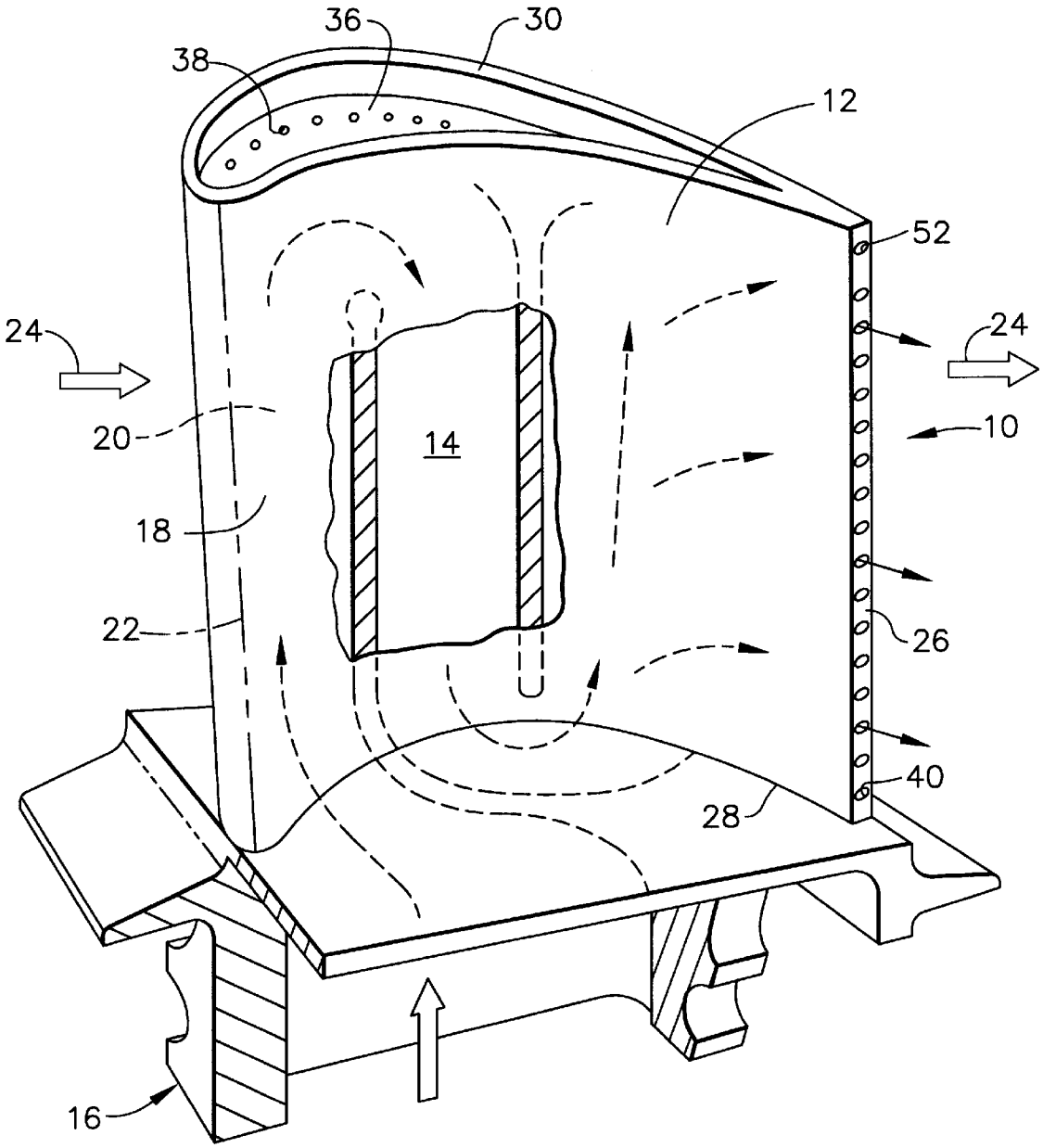
FIG. 1 shows a partly sectional view of an exemplary gas turbine rotor blade.

Illustrated in FIG. 1 is a gas turbine engine rotor blade 10 of the present invention having an airfoil 12 with an internal cooling cavity 14 and an integral conventional dovetail 16 for mounting the airfoil 12 to a rotor disk (not shown) in a conventional manner. Although the present invention is equally applicable to all types of airfoils, the rotor blade 10 is representative of a first stage rotor blade disposed immediately downstream from a high pressure turbine nozzle (not shown) through which is channeled relatively hot combustion gas generated in a combustor (not shown).

The airfoil 12 includes a concave side wall 18, defining a pressure surface, and a convex side wall 20, defining a suction surface, which are joined together at a leading edge 22, where the combustion gas 24 enters the rotor stage, and a downstream spaced trailing edge 26, where the combustion gas 24 exits the rotor stage. The airfoil 12 extends radially upward from a root 28, disposed at the top of the dovetail 16, to a tip 30. The chord of the airfoil 12 is the length of a straight line connecting the leading edge 22 and the trailing edge 26 and the direction from the leading edge 22 to the trailing edge 26 is typically described as the chordwise direction. A chordwise line (not shown) bisecting the pressure surface 18 and the suction surface 20 is typically referred to as the meanline of the airfoil 12.

Internal cooling of turbine rotor blades is well known and typically utilizes a portion of a relatively cool compressed air bled from a compressor (not shown) of the gas turbine engine which is suitably channeled through the respective dovetails of several rotor blades mounted around the perimeter of the rotor disk (not shown). The internal cooling cavity 14 may take any conventional form and is typically in the form of a serpentine cooling passage. The cooling fluid enters the internal cooling cavity 14 from the dovetail 16 and passes therethrough for suitably cooling the airfoil 12 from the heating effect of the combustion gas 24 flowing over the outer surfaces thereof. Film cooling holes (not shown) may be disposed on the concave 18 or convex 20 surfaces, or both, for conventionally film cooling the surfaces. The outer radial boundary of the internal cooling cavity 14 is defined by a tip cap 36. Cooling air is typically discharged in part from the internal cooling cavity 14 through a plurality of tip cap holes 38 extending through the tip cap 36 and trailing edge holes 40 disposed along trailing edge 26.

Figure 2:
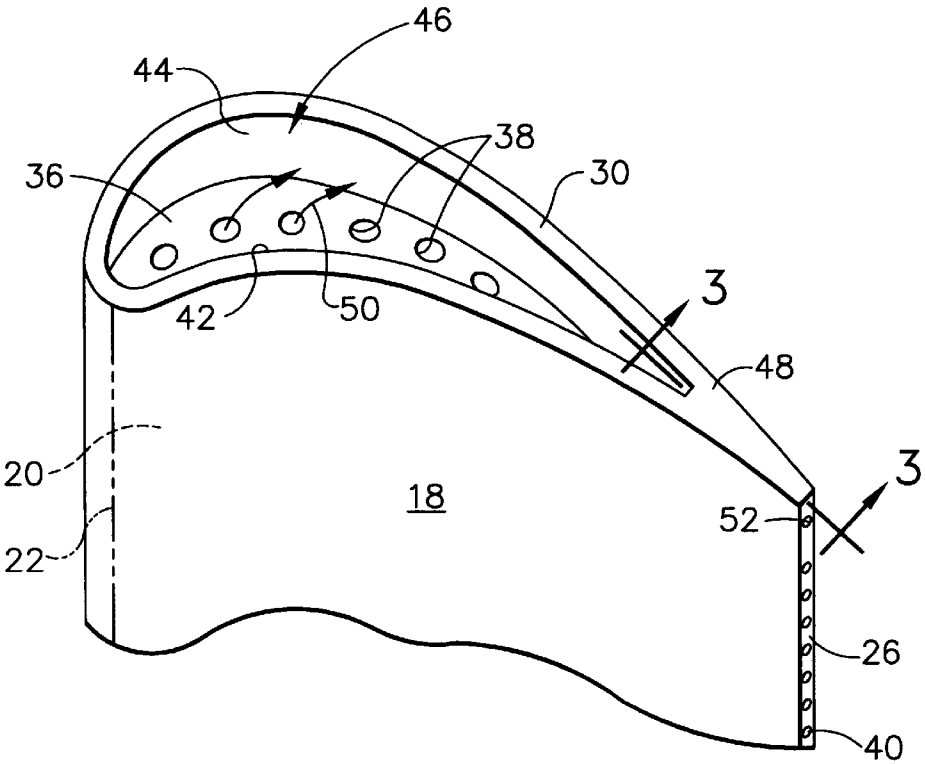
FIG. 2 shows a tip cavity region of the exemplary gas turbine rotor blade depicted in FIG. 1.

As shown in FIG. 2, the tip cap 36 typically includes a concave or pressure side tip wall 42 extending from adjacent the airfoil leading edge 22, along the airfoil pressure side wall 18, to adjacent the trailing edge 26 and a convex or suction side tip wall 44 extending from adjacent the leading edge 22, along the airfoil suction side wall 20, to adjacent the trailing edge 26. The convex or suction side tip wall 44 is laterally spaced from the pressure side tip wall 42 forming a tip cavity or open plenum 46 there between. The pressure side tip wall 42 and the suction side tip wall 44 are typically integrated with the corresponding airfoil pressure side wall 18 and suction side wall 20.

The trailing edge 26 of the rotor blade 10 is particularly thin, lacking the appropriate wall thickness to enable open plenum 46 to span the entire chord length of the blade to the trailing edge 26. Therefore, a trailing edge tip 48 is formed between the open plenum 46 and the trailing edge 26. Cooling air 50, entering the open plenum 46 through the tip cap holes 38, provides a means for cooling the radially extending side walls of the open plenum 46 but not the trailing edge tip 48. In prior art cooling arrangements, additional cooling holes extend radially through the trailing edge tip 48 to the internal cavity 14 in order to prevent oxidation of this region of the blade tip. The penalty of this prior art arrangement is that additional cooling air is drawn from the internal cooling cavity 14 resulting in reduced cooling of the airfoil trailing edge 26.

Figure 3:
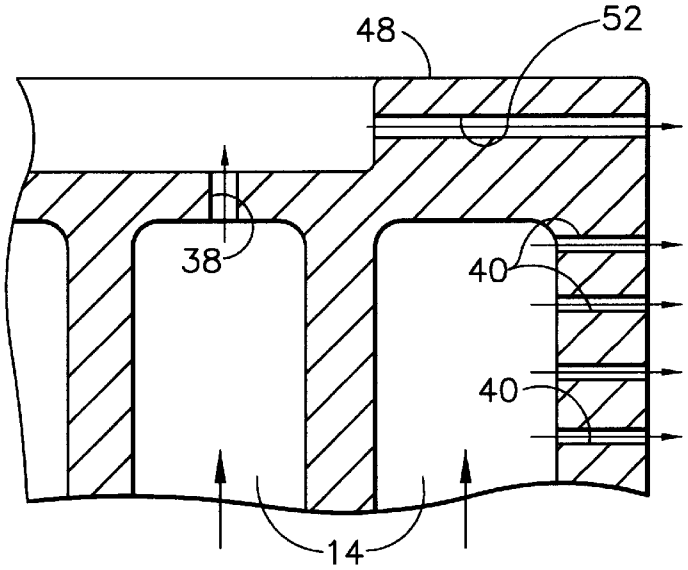
FIG. 3 shows a view of the trailing edge of the blade portion depicted in FIG. 2 taken along line 3—3, illustrating in detail a radial hole through the blade tip cap connecting the tip cavity to the internal cooling cavity and a hole running chordwise along the meanline of the airfoil connecting the tip cavity to the trailing edge of the blade.

In accordance with the present invention, cooling of the trailing edge tip 48 is accomplished without having to extract additional cooling air from the internal cooling cavity. As best seen in FIG. 3, a recuperative hole or aperture 52 running along the meanline of the airfoil connects the blade trailing edge 26 to the open plenum 46. The aperture 52 is sized so as to provide sufficient cooling of the airfoil trailing edge 26. Typically the diameter of the aperture 52 is about one half the thickness of the airfoil trailing edge 26. Since the pressure in the open plenum 46 is higher than the combustion gas pressure at the blade trailing edge tip 48, a portion of the cooling air 50 in the open plenum 46 flows through the recuperative hole 52 to the blade trailing edge tip 48. Since the temperature of the cooling air 50 exhausting from the internal cooling cavity 14 to the open plenum 46 is typically less than the blade trailing edge tip 48, convective cooling is achieved.

The recuperative hole 52 can be either cast or drilled using a laser, electro-stream, electro-discharge machining, stem drilling, or some other suitable means.

Figure 5:
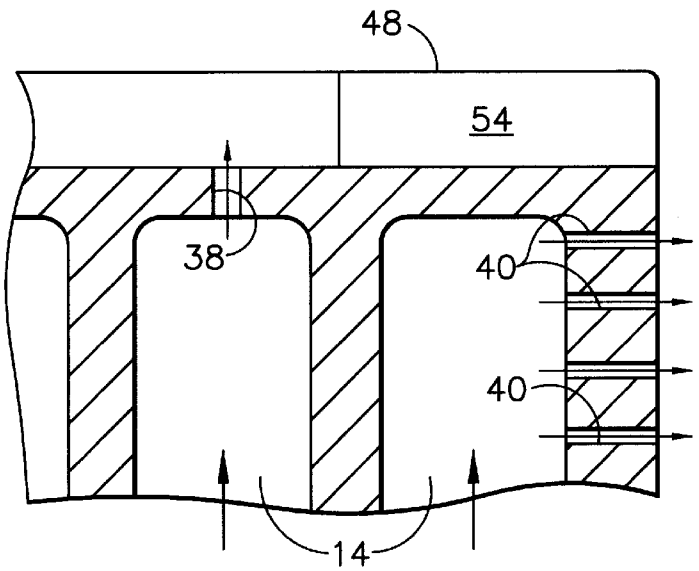
FIG. 5 shows a view of the trailing edge of the blade portion depicted in FIG. 4 taken along line 3—3, illustrating in detail a radial hole through the blade tip cap connecting the tip cavity to the internal cooling cavity and a channel running chordwise along the meanline of the airfoil connecting the tip cavity to the trailing edge of the blade.
Figure 4:
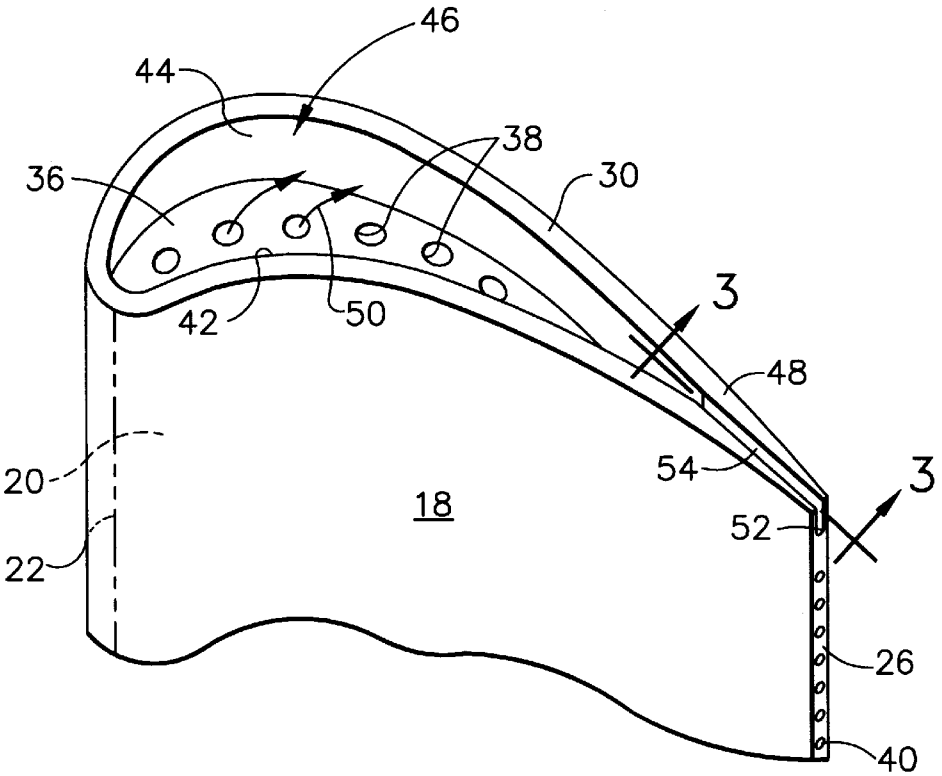
FIG. 4 shows an alternate embodiment of the tip cavity region of the exemplary gas turbine rotor blade depicted in FIG. 1.

In another embodiment as illustrated in FIGS. 5 and 6, cooling of the trailing edge tip 48 is accomplished by way of a channel 54 running along the meanline of the airfoil connecting the blade trailing edge 26 to the open plenum 46. The channel 54 is in the form of a U-shaped cross section having an open top. The channel 54 is sized so as to provide sufficient cooling of the airfoil trailing edge 26. Typically the width of the channel 54 is about one half the thickness of the airfoil trailing edge 26. Again, since the pressure in the open plenum 46 is higher than the combustion gas pressure at the blade trailing edge tip 48, a portion of the cooling air 50 in the open plenum 46 flows through the channel 54 to the blade trailing edge tip 48. Since the temperature of the cooling air 50 exhausting from the internal cooling cavity 14 to the open plenum 46 is typically less than the blade trailing edge tip 48, convective cooling is achieved.

The channel 54 can be either cast or drilled using a laser, electro-stream, electro-discharge machining, stem drilling, or some other suitable means.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

What is claimed is:

1. A turbine blade including an airfoil with a leading edge and a trailing edge, a pressure side wall and a suction side wall connected at the leading edge and the trailing edge, and a tip, said turbine blade comprising:

an internal cavity within the airfoil for receiving cooling fluid;

a tip cavity formed at the tip;

said tip cavity comprising an open plenum including a tip cap recessed from the tip and surrounded by the pressure and the suction side walls, said tip cap being connected to said side walls along the periphery of said tip cap;

a passage between the internal cavity and the tip cavity for providing cooling air to the tip cavity; and a means for cooling the tip of the airfoil at the trailing edge using cooling air from the tip cavity.

2. The turbine blade according to claim 1, wherein the means for cooling the tip of the airfoil at the trailing edge comprises at least one aperture connecting the tip cavity with the airfoil trailing edge.

3. The turbine blade according to claim 2, wherein said aperture extends along the meanline of said airfoil.

4. The turbine blade according to claim 1, wherein the means for cooling the tip of the airfoil at the trailing edge comprises at least one channel connecting the tip cavity with the airfoil trailing edge.

5. The turbine blade according to claim 4, wherein said channel extends along the meanline of said airfoil.

* * * * *